United States Patent [19]

Byrne

[11] Patent Number: 4,747,788

[45] Date of Patent: May 31, 1988

[54] MANUALLY OPERABLE RETRACTABLE POWER CENTER

[76] Inventor: Norman R. Byrne, 2736 Honey Creek, NE., Ada, Mich. 49301

[21] Appl. No.: 7,622

[22] Filed: Jan. 28, 1987

[51] Int. Cl.[4] ..... H01R 13/44; H01R 13/60

[52] U.S. Cl. ..... 489/131; 174/48; 174/57; 439/531; 439/544; 439/571; 439/576

[58] Field of Search ..... 174/48, 57; 339/34, 339/125 R, 126 R, 135; 439/576, 571, 544, 531, 131

[56] References Cited

U.S. PATENT DOCUMENTS

| | | | |
|---|---|---|---|
| 2,811,574 | 10/1957 | Guerrero | 174/57 |
| 3,433,886 | 3/1969 | Myers | 339/34 |
| 3,622,684 | 11/1971 | Press | 339/34 |
| 3,646,244 | 2/1972 | Cole | 174/57 |
| 3,794,956 | 2/1974 | Dubreuil | 174/48 |
| 4,511,198 | 4/1985 | Mitchell et al. | 439/131 |
| 4,551,577 | 11/1985 | Byrne | 174/48 |

*Primary Examiner*—Eugene F. Desmond
*Assistant Examiner*—Paula A. Austin
*Attorney, Agent, or Firm*—Varnum, Riddering, Schmidt & Howlett

[57] ABSTRACT

A retractable power center (100) for providing conveniently located electrical power source receptacles (170) is adapted to be mounted in a work surface (104) such as a desk top or similar article of furniture. The power center (100) is manually operable and includes a stationary upper housing (108) received within a slot (102) formed in the work surface, and a clamping arrangement (118, 128, 138) to secure the housing (108) to the work surface (104). In addition, a manually movable and slideable power carriage (150) is utilized to mount the receptacles (170). In response to manually exerted forces on the power carriage (150), the carriage can be extended upward into an open position. Relatively small bosses (180) extend laterally from lateral sides of the carriage (150) and provide a means to support the carriage (150) in its extended position, with the bosses (180) resting on the top portion of the housing (108). Still further, ledges (182) are integrally formed on the lateral sides of the carriage (150) near the bottom portions thereof, so as to prevent any further additional movement of the carriage (150) upwardly relative to the housing (108).

3 Claims, 2 Drawing Sheets

MANUALLY OPERABLE RETRACTABLE POWER CENTER

DESCRIPTION

1. Technical Field

The invention relates to electrical power source enclosures and, more particularly, to power centers mountable in furniture assemblies, work benches and the like, and comprising electrical receptacles.

2. Background Art

Historically, electrical receptacles have long been used for supplying power to various types of relatively portable devices, such as fans, lamps, electric typewriters, and the like. One problem common to relatively all types of residential, commercial and industrial environments utilizing electrical power outlet receptacles is the positioning of the same in a manner so as to facilitate both convenience and cost efficiency.

When designing the electrical layout of a commercial or industrial environment, it is well-known that wiring costs can be relatively high if a sufficient number of electrical power outlet receptacles are not utilized and properly positioned. However, the cost of the electrical materials also rapidly increases as a number of power source receptacles is increased. In addition, and perhaps more importantly, the conventional design of single- or double-unit receptacles within walls or floor surfaces, which are often a substantial distance from electrical devices such as those employed on work surfaces (typewriters, computer terminals, etc.), often causes relatively unsightly and sometimes dangerous wiring arrays, in addition to resultant entanglements of the electrical cords connected to these devices.

To overcome problems of efficiency and convenience of electrical outlet design, it is relatively common to employ multiple receptacle raceways having a number of receptacles and a power source cord plugged into a utility outlet. Again, however, these raceways can still result in unsightly and entangled arrays of electrical cords interconnecting the devices to be powered. In addition, these raceways are often located on floor surfaces and, therefore, are not particularly convenient.

To partially overcome this problem, it is also known to employ electrical receptacles rigidly and directly mounted to various types of furniture, such as bookshelves, desks and other furniture arrangements employing work surfaces and the like. These receptacles are often mounted in a location substantially above the floor surface and allow the user to "plug in" electrical devices nearer their location of use, thereby avoiding the necessity of running device cords a substantial distance. However, rigidly-secured receptacles must be mounted in a manner so that the user can readily insert electrical plugs connected to the device cords. Accordingly, the receptacles are typically in fairly "open" locations and the device cords can again prove to be unsightly and space-consuming, especially disadvantageous when the devices to be powered are not in use. Alternatively, if the receptacles are substantially hidden from view, such receptacles can be extremely difficult to manually access.

As an example of directly-mounted receptacles, the U.S. Pat. No. to Konig, 3,883,202, issued May 13, 1975,shows a desk having an integrally incorporated transverse trough, with receptacles located in the trough bottom. Electrical supply lines can be laid in the trough and extended through longitudinal slots in the rear of the desk. The arrangement is not particularly aesthetically desirable, and the receptacles are somewhat difficult to access.

It is known to employ electrical receptacles in floor outlet assemblies, whereby the receptacles can be moved between a retracted, closed position (with the receptacles hidden from view) to an extended, open position, with the receptacles accessible. For example, the Cole, U.S. Pat. No. 3,646,244, issued Feb. 29, 1972, discloses a floor receptacle having an inner housing moveable within a stationary casing held in a circular opening provided in a concrete floor. The Cole device includes a cover plate having a circular well which seats a cap within a slot. The cap forms the head of a bolt, and the latch member includes latching end portions threaded into the bolt. The latching end portions are normally positioned in slots of the moveable housing. To withdraw the housing from the casing, the cap is rotated by using a tool (coin, etc.) in one of the cap slots. When the cap and the corresponding bolts are rotated, the latching end portions are removed from the slots and the bolt and cap "pop up". The moveable housing remains stationary and must then be manually lifted out of the casing.

In another example, the Dubreuil, U.S. Pat. No. 3,794,956, issued Feb. 26, 1974, discloses a floor outlet assembly having a stationary outer member and a telescoping inner member. The inner member is biased toward an extended operative position by a spring. A locking mechanism is employed to lock the inner member within the outer member in a closed position, and includes a finger element adapted to be pushed into a notch formed at the upper end of the member when the member is in a retracted, inoperative position. To release the locking mechanism, an unlocking mechanism includes a disc element mounted for rotation about an axis offset from a central bore of the case and secured by a screw. With the inner member in the inoperative position and the finger element locked within the notch, a pronged key is inserted in the key holes formed in the disc. The disc is then rotated in a specific direction to bring a stud upward to compress a spring and move the finger element out of the notch. The inner member is then free to move upward under the biasing of the spring. The electrical socket of Dubreuil remains deenergized and nonconductive at all times when the inner member is in its retracted position.

As earlier stated, the aforedescribed Cole and Dubreuil patents are specifically directed to floor outlet assemblies. One problem associated with receptacles rigidly mounted in floor outlets, or otherwise rigidly mounted in various types or furniture, relates to the development of modular furniture systems, which are rapidly gaining increased use in all types of environments. These furniture systems often employ modular and interchangeable furniture components. In some instances, a number of receptacles may be required at a work station, such as a secretarial work place having a typewriter, computer display terminal and the like. Other work stations having similar furniture components may require few, if any, receptacles. Accordingly, it is advantageous to selectively choose and locate the number of receptacles available to the user.

One system employing covered receptacles mounted within in a work station is disclosed in the Propst et al U.S. Pat. No. 4,372,629, issued Feb. 8, 1983. The Propst et al arrangement includes a desk top having a rear cover hinged to a vertical back panel. Receptacles are mounted to the lower portion of the cover and bristles extend horizontally from the cover to an edge of the desk top when the cover is closed. When the cover is open, the user can "plug in" the cord of a desired electrical device and close the cover, with the cord then extending through the bristles.

Although the Propst et al arrangement is relatively more aesthetically pleasing than any other known arrangement, the necessity of manually opening the hinge covering at the rear of the desk top is somewhat inconvenient for the user. In addition. the arrangement requires a combined work surface and back panel configuration, and the hinged cover is not secured in any manner when it is in a closed position.

One relatively substantial advance over the prior art relating to the mounting of electrical receptacles in a retractable manner in work surfaces and the like, is shown in the commonly owned Byrene U.S patent application Ser. No. 517,182, filed July 25, 1983, now U.S. Pat. No. 4,551,577. In the Byrne application, a retractable power center includes a retangular housing formed in the work surface with a clamping arrangement to secure the housing to the work surface. A lower extrusion is connected to a lower portion of the housing, and a moveable power carriaqe mounts the receptacles and a catch assembly which releasably maintains the carriage in a closed, retracted position. In response to manual activation, the catch assembly is released and springs tensioned between the carriage and the extrusion exert forces so as to extend the carriage upward into an extended, open position. In the open position, the user can energize desired electrical devices from the receptacles and then lower the carriage into the releasably secured, retractable position.

Although the Byrne patent application represents a substantial advance with respect to retractable power centers mounted in work surfaces and the like, it can also be advantageous to employ a retractable power center having a relatively more simple construction. That is, the use of spring or similar arrangements can sometimes result in additional repair and maintenance costs. So further, the use of a relatively long extrusion and the spring assemblies can also result in higher initial costs.

SUMMARY OF THE INVENTION

In accordance with the invention, a manually-operable power center is adapted to be mounted in a desk or other furniture item having a work surface at a working height. The work surface includes a slot formed in the surface, and the power center includes stationary housing means mounted within the slot. Electrical receptacle means supply electrical power from an interconnected common power source to selectively interconnected electrical devices. Carriage means are received within the housing means to mount the receptacle means so as to be vertically moveable with respect to the housing means between a closed, retracted position and an extended, open position. The carriage means includes opposing lateral sides, and first support means extend outwardly from the opposing lateral sides to support the carriage means in the extended, open position, with the first support means abutting the housing means when the carriage means is in the extended, open position.

The first support means includes a pair of at least slightly resilient elements, with each element extending outwardly from one of the opposing lateral sides of the carriage means. The elements are of a size and configuration so that the user can manually exert sufficient forces on the carriage means so as to move the carriage means and the resilient elements upwardly through the housing means, while the carriage means can still be supported in the extended, open position by the elements resting on an upper portion of the housing means. In accordance with one aspect of the invention, the resilient elements can include a pair of bosses constructed integrally with the opposing lateral sides of the carriage means.

The power center can also include stop means mounted to the carriage means to prevent the carriage means from being extended upwardly from the housing means greater than a predetermined distance. The stop means can include a pair of ledges extending outwardly near the lower portions of the opposing lateral sides of the carriage means. The ledges are of a size and configuration so as to abut a lower portion of the housing means when the carriage means is extended upwardly a predetermined distance relative to the closed, retracted position of the carriage means. The vertical distance between the first support means and the stop means can be slightly greater than the distance between the uppermost portion of the housing means and the lowermost portion of the housing means.

The power center can also include lift engaging means mounted to an upper portion of the carriage means so as to allow the user to exert upwardly-directed forces on the carriage means. These forces can move the carriage means and the electrical receptacle means between the closed, retracted position and the extended, open position. The lift engaging means can include a horizontally-disposed cover plate ounted on an upper portion of the carriage means, with the cover plate substantially flush with the uppermost portion of the housing means when the carriage means is in the closed, retracted position.

The power center can also include second support means mounted to an upper portion of the carriage means to support the carriage means on the housing means when the carriage means is in the closed, retracted position. The second support means can include a cover plate mounted on an upper portion of the carriage means, with the cover plate resting on an upper portion of the housing means and supporting the weight of the carriage means when the carriage means is in the closed position.

The receptacle means are mounted to the carriage means so that electrical devices can remain energized from the power source when the carriage means is in the closed position. The power center also includes clamping means coupled to the housing means and rigidly securing the housing means to the work surface. The clamping means can include a pair of inwardly-directed flanges mounted to the inner surfaces of the housing means, with a central flange portion extending from a top portion of the housing means to a position below a vertical midpoint of the housing means. Side flange portions are integral with the central portion and extend downwardly to a bottom portion of the housing means, with opposing guide slots formed in the side flange portions. L-shaped locking members are associated with each of the inwardly-directed flanges, and each member includes a vertical upright extending upwardly in a manner so as to be adjacent outer vertical surfaces of the housing means. A horizontally-disposed base portion of the locking members is integral with an associated vertical upright, and vertically-disposed tabs are integral with the base portion and sized so as to be slidable within the guide slots.

Threaded bores extend in a vertical direction in each of the central portions, and in each of the horizontally-disposed base portions. Threaded means are rotatably secured within the threaded bores, so that rotation of the threaded means causes upward or downward movement of the locking members relative to the housing means as a result of the vertical tabs being maintained within the guide slots. The housing means are rigidly secured to the work surface by the vertical uprights being abutted against and under a lower portion of the work surface.

The power center can also include a cover plate positioned within the housing means and substantially hiding from view the receptacle means below the work surface when the carriage means is in the closed position. In addition, a pair of grooves can be integrally formed on inner vertical surfaces of the housing means so as to extend upwardly from a lowermost position of the housing means to a position near a top portion of the housing means. The pair of bosses can be aligned with the grooves so as to be receivable within the grooves when the carriage means is moved upwardly toward the extended, open position.

The carriage means can include an elongated receptacle box having a rectangular cross-sectional configuration, with opposing lateral vertically-disposed sides, and a further side having the electrical receptacle means mounted thereto. A pair of at least slightly resilient elements extends outwardly from the opposing lateral sides of the receptacle box to support the box in the extended position, with the resilient elements resting on an upper portion of the housing means when the receptacle box is in the extended position In addition, the housing means can include a horizontally-disposed collar having a rectangular opening and an outer perimeter adapted to rest on the upper surfaces of the work surface. The housing means can also include a casing extending downwardly from the collar, with a rectangular cross-sectional configuration adapted to be fitted within the slot of the work surface. Further, the power center can also include at least one circuit breaker conductively interconnected between the electrical receptacle means and the common power source so as to protect interconnected electrical devices in the event of circuit overload or electrical malfunction.

BRIEF DESCRIPTION OF THE DRAWINGS

The invention will now be described with reference to the drawings in which.

DETAILED DESCRIPTION

The principles of the invention are disclosed, by way of example, in a manually-operable and retractable power center 100 as depicted in FIGS. 1–5. The power center 100 is adapted to be maintained in a lowered, closed position when not in use, whereby subsequently described electrical receptacles and other portions of the power center 100 are substantially hidden from view. In addition, the power center 100 is further adapted to be responsive to manually exerted forces so as to be extended upwardly into an open position, whereby the electrical receptacles are then readily accessible to the user for inserting power cords and plugs from electrical devices to be energized. The power center 100 is also adapted to be readily maintained in the open position with the use of relatively simple and inexpensive structure, not requiring spring assemblies or any other types of relatively complex locking or clamping mechanisms. Finally, the power center 100 is also operable to retract to the closed position so that the electrical receptacles are substantially hidden from view, while the electrical devices still remain energized from power cords received by the receptacles.

Figure 1:
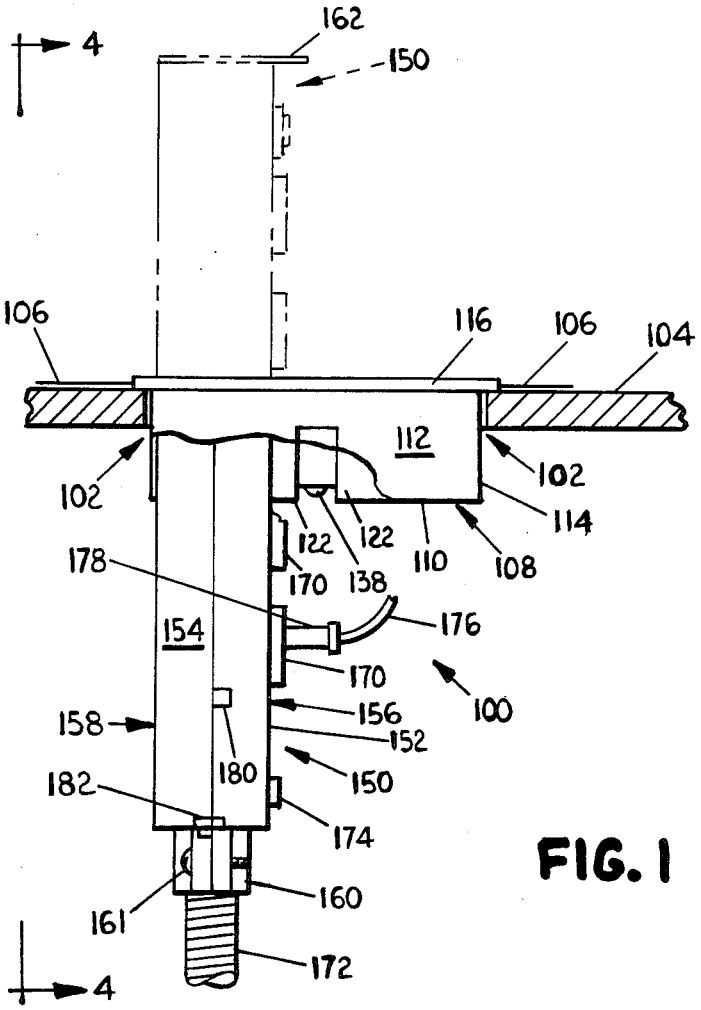
FIG. 1 is an elevational view of one embodiment of a manually-operable retractable power center in accordance with the invention, with side portions of the housing wall and power carriage partially broken away.
Figure 2:
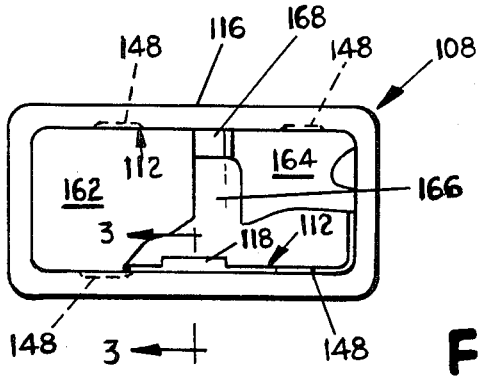
FIG. 2 is a plan view of the manually-operable power center depicted in FIG. 1, with portions of the cover assembly partially broken away.
Figure 3:
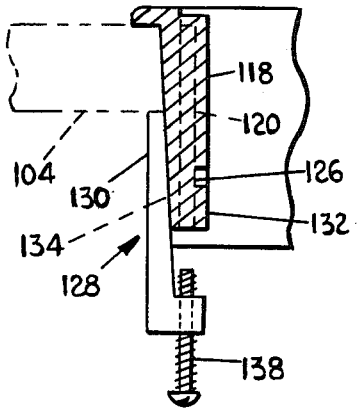
FIG. 3 is a fragmentary sectional view of one of the clamping assemblies of the manually-operable power center depicted in FIG. 1, taken along lines 3—3 of FIG. 2.

As primarily shown in FIGS. 1 and 2, the power center 100 is adapted to be mounted within a rectangularlyshaped slot 102 formed within a furniture component such as the work surface 104 partially depicted in FIGS. 1 and 3. Work surface 104 can, for example, be the working surface of a desk or similar furniture component. Typically, the work surface 104 may have a veneer 106 or other conventional protective and aesthetically desirable surface secured to the top of enter 100 provides a the work surface 104. The power c structurally sound, relatively simplistic structure and aesthetically desirable means for transferring power from a conventional power source located below the work surface 104 to one or more electrical outlet receptacles nearer the top of work surface 104, and then to electrical devices (not shown) to be energized from the receptacles.

Figure 4:
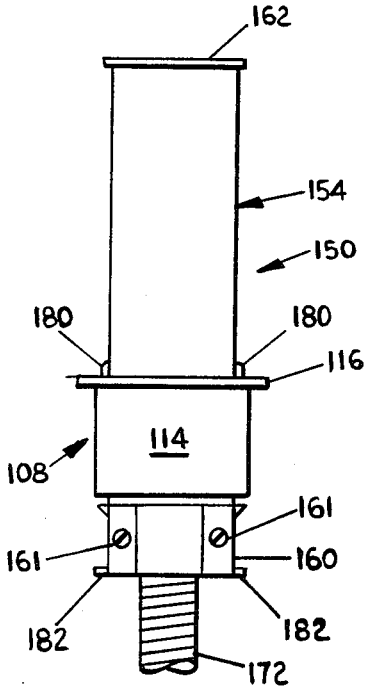
FIG. 4 is an end view of the power center separated from the work surface and showing the power carriage in an extended, open position, the view being taken along lines 4—4 of FIG. 1.
Figure 5:
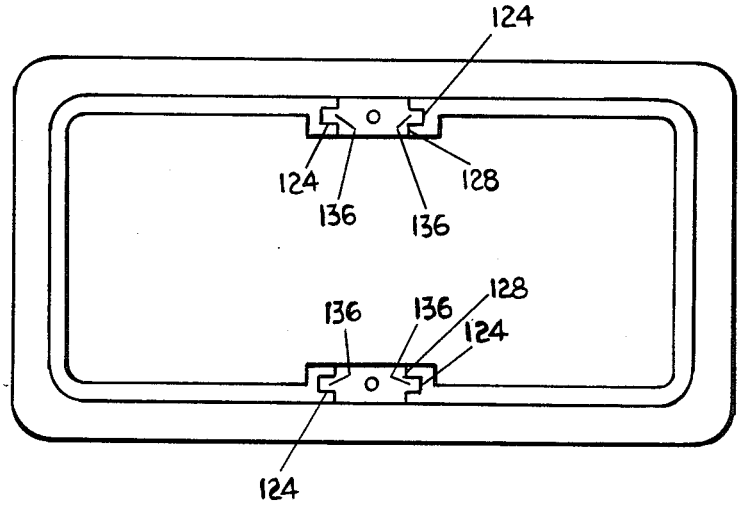
FIG. 5 is an underside view of the rectangular housing of the manually-operable retractable power center shown in FIG. 1, with the power carriage removed and locking tabs shown.

Referring to FIGS. 1, 2, 4 and 5, the power center 100 includes a stationary upper housing 108 (shown separately from other components of the power center 100 in FIG. 5). The upper housing 108 is essentially retangular in shape and includes a vertically-disposed and retangularly-shaped casing 110 The casing 110 is formed by vertically-disposed lateral side portions 112 and opposin9, vertically-disposed end portions 114 which can be integral with the lateral side portions 112. For purposes of description, the lateral side portion 112 depicted in FIG. 1 has been partially cut away. Mounted to the upper edge of the casing 110 formed by the side portions 112, 114, and preferably integral therewith, is a horizontally-disposed collar 116 also having a substantially retangular configuration. Again, for descriptive purposes, the collar 116 has been partially cut away in the views depicted in FIGS. 1 and 2.

The rectangularly-shaped slot 102 formed in the work surface 104 is configured to have a length and width slightly larger than the corresponding distance between the lateral side portions 112 and the distance between opposing end portions 114 of the housing 108. Conversely, the length and width corresponding to the outer perimeter of the horizontally-disposed collar 116 are slightly larger than the corresponding dimensions of the slot 102. Accordingly, when the housing 108 is mounted in the slot 102, the casing 110 is positioned below the veneer 106 on the top of work surface 104. Correspondingly, the outer perimeter of the collar 116 overhangs the slot 102 so as to be positioned above the work surface 104 with the lower surface of the collar 116 substantially flush with the veneer 106. In this manner, the collar 116 provides a supporting surface for the housing 108.

To rigidly secure the housing 108 to the work surface 104, the casing 110 includes a pair of opposing inwardly-directed flanges 118 whicn are positioned near the central portion of, and preferably integral with, the lateral side portions 112 of casing 110. The inwardly-directed flanges 118 each include a central portion 120 which substantially extends from the top of the casing 110 to a position somewhat below a vertical midpoint of each lateral side portion 112. In addition, each inwardly-directed flange 118 also includes a pair of side flange portions 122 formed in a preferably integral manner with the central portion 120. The side flange portions 122 each extend downwardly to the bottom edge of the casing 110. The side flange portions 122 include opposing guide slots 124 (FIG. 5) formed in a manner so that the slots 124 extend in a vertical configuration downward from the bottom of the central portion 120 to the lower edge of the casing 110. The central portion 120 of each of the flanges 118 includes a threaded bore 126 extending completely through the central portion 120 in a vertical orientation.

In addition to the inwardly-directed flanges 118, the arrangement for locking and securing the housing 108 to the work surface 104 also incluces a pair of L-shaped locking members 128, with each locking member associated with a corresponding inwardly-directed flange 118. As primarly shown in FIG. 3, each of the locking members 128 includes a vertical upright 130 which, when the housing 108 is secured to the work surface 104, extends upwardly outside of the corresponding side portion 112 and adjacent the corresponding flange 118. Each locking member 128 also includes a horizontally-disposed base portion 132 preferably integral wirh the upright 130 and mounted so as to be positioned substantially directly below the central portion 120 of each corresponding flange 118.

In addition to the foregoing, each of the L-shaped locking members 128 also includes a clearance hole 134 having a vertical orientation and extending through the horizontally-disposed base portion 132. When the locking arrangement is properly positioned and secured, the clearance hole 134 of the locking member 128 is aligned with a corresponding threaded bore 126 in the central portion 120 of the corresponding flange 118.

Still further, each of the L-shaped locking members 128 also includes a pair of vertically-disposed and elongated tabs 136. The tabs are preferably integral with the horizontally-disposed base portion 132 and extend outwardly from the sides thereof. The tabs 136 are sized and configured so that they can be extended upwardly from the bottom of the side flange portions 122 and slideably inserted within the guide slots 124. Finally, the locking arrangement also includes a pair of machine screws 138 or similar and conventional threaded components which are adapted to be threaded within the threaded bores 126 and the clearance holes 134 of the flanges 118 and locking members 128, respectively.

The L-shaped locking members 128 are preferably preassembled into the guide slots 124 of the housing 108. The screws 138 are also inserted into the bores 126 and 134 prior to securing the housing 108 within slot 102 of work surface 104. In addition, the members 128 are preferably at an inclined plane so that when the members 128 are at a lower extended position, they will move inwardly when the housing 108 is positioned in the work surface 104. The members 128 will then expand outwardly when the screws 138 are tightened.

To appropriately secure the housing 108 within the slot 102 of work surface 104, the housing 108 is first positioned so that the casing 110 is received within the slot 102. In this position, the upper edges of the vertical uprights 130 are located below the bottom surface of the work surface 104. The screws 138 are then inserted into clearance holes 134 of the members 128. However, with the vertical tabs 136 secured within the guide slots 124, the L-shaped members 128 are prevented from any corresponding rotation with the screws 138. In this manner, with the screws 138 ratated in an appropriate direction, the L-shaped locking members 128 will be forced upwardly until the upper edges of the vertical uprights 130 are snugly fitted against the bottom of the work surface 104. Correspondingly, the housing 108 is also clamped in a manner so that the collar 116 is forced tightly against the veneer 106 of the work surface 104. The screws 138, L-shaped locking members 128 and inwardly-directed flanges 118 can be characterized as a clamping means for securing tne power center 100 within the slot 102 formed in work surface 104.

In addition to the foregoing, the stationary upper housing 108 also includes a pair of inwardly-directed and opposing grooves 148 which are formed on the inner surfaces of the lateral side portions 112 of casing 110. The grooves 148 are vertically oriented and extend from the bottom edges of the casing 110 upwardly to a location somewhat below the top edges of the casing 110. The purposes of the grooves 148 will be described in subsequent paragraphs herein.

The power center 100 further includes a manually-operable and retractable power carriage 150 having a normally closed position as depicted in FIGS. 1 and 2. The power carriage 150 comprises a rectangularly-shaped and elongated hollow receptacle box 152 having vertically-disposed lateral side portions 154. The receptacle box 152 also includes a receptacle-mounting end portion 156 and a rear end portion 158, each preferably integral with the lateral side portion 154. The receptacle box 152 also includes a lower connecting flange 160 mounted to the underside portion of the box 152. Preferably, the receptacle box 152 can be formed by two half portions which are secured together by screws, rivets, or the like, such as the connecting screws 161 connecting the two half portions of the lower flange 160 as shown in FIG. 1, which also acts as a cord or cable clamp for the incoming power source. In addition, as apparent from the configuration of the lower flange 160, the receptacle box 152 also includes a lower horizontally-disposed surface integral with the side portions 154 and the portions 156, 158 so as to form an enclosure of the receptacle box 152.

The receptacle box 152 can also include an upper cover plate 162 which is horizontally-disposed and sized so as to fit essentially flush with the collar 116 when the receptacle box 152 is in a lower, closed position. The cover plate 162 can be secured to the upper portion of the lateral side portions 154 and portions 156, 158 in any suitable and conventional manner. In addition to the upper cover plate 162, and altnough not part of the power carriage 150, the power center 100 can also include a second separate cover plate 164 which can be utilized to at least partially enclose a portion of the opening within the collar 116 which is not enclosed by the first upper cover plate 162 when the receptacle box 152 is in a closed position. Preferably, the second cover plate 164 is sized so as to be substantially flush with the horizontally-disposed collar 116 but is configured so as to form a power cord opening 166 between the upper cover plate 162 and the second cover plate 164, or at the opposing end of cover plate 164.

Although optional with respect to the principal concepts of power centers in accordance with the invention, the power center 100 can also include a set of flexible brushes 168 which extend outwardly from the second cover plate 164 and also extend over the power cord opening 166. The brushes 168 can be secured to the second cover plate 164 in any suitable manner, such as by means of a notch or similar arrangement in the second cover plate 164, in which one end of the brushes 168 can be secured. As will be apparent from subsequent description herein, the brushes 168 can provide a flexible means for allowing electrical device cords to be energized from the power center 100 when the power center 100 is in a normally closed and retracted position.

Referring to FIGS. 1, 2 and 4, the power center 100 also includes a pair of electrical receptacles 170 mounted to the receptacle-mounting side 156 of power carriage 150. The receptacles 170 face toward the right side of the drawing as depicted in FIG. 1, are vertically aligned and include electrical wires or other suitable conductive elements (not shown) which extend downwardly and are energized by a power supply through a common power source cord or cable 172 as depicted in FIG. 1. The common power source cord 172 can extend upwardly through an aperture formed in the lower flange 160 or through any suitable opening in the power carriage 150, and is conductively connected in any suitable and conventional manner to the receptacles 170. Preferably, the conductive path between the receptacles 170 and the common power source cord 172 also includes one or more fuse or circuit breaker conponents 174 for purposes of overload protection. In addition, the conductive path between the receptacles 170 and the common power source cord 172 can also include a suitable and conventional reset circuit switch or other means to allow manual reset of the conductive path if an overload occurs and the overload is thereafter removed.

It should also be noted that the receptacle box 152 could be double-sided with four outlet receptacles and a pair of circuit breakers to supply twice the available outlet capacity. In addition, the length of the receptacle box 152 could be extended so as to provide space for several more receptacles.

As depicted in FIG. 1, one of the receptacles 170 energizes an electrical device (not shown) having a device power cord 176 and a device plug 178. With the power center 100 and associated power carriage 150 in the closed position as depicted in FIG. 1, the electrical device power cord 176 extends from one of the receptacles 170 upwardly through tne optional flexible brushes 168 to the electrical device for which power is to be supplied. In addition, the device power cord 176 may be coiled within the spatial area formed below the housing collar 116 adjacent the receptacle box 152 before extending upwardly through the brushes 168.

As principally shown in FIGS. 1 and 4, the power carriage 150 includes a pair of laterally-extending bosses 180, with one boss formed on each of the lateral side portions 154 of the receptacle box 152. The bosses 180 are each positioned at a location somewhat below a vertical midpoint of the receptacle box 152. In addition, each of the bosses 180 is horizontally aligned so as to be in vertical alignment witn a corresponding one of the grooves 148 formed on the inner right-hand portions of the surfaces of housing casing 110 as the casing 110 is shown in FIG. 1. Preferably, the bosses are integrally formed on the lateral side portions 154 and are of a size so that the housing 108 can freely move downward along the sides of the receptacle box 152 while the bosses 180 are within the grooves 148. In addition, the bosses should be at least slightly resilient or otherwise configured so that they can be "forced" through the casing 110, even when moved above the grooves, when a sufficient amount of force is manually exerted on the carriage 150.

Still further, the power carriage 150 also includes a pair of shelves or ledges 182, with one ledge formed at the bottom of each of the lateral side portions 154 of the receptacle box 152. Preferably, the ledges 182 are integrally formed with the lateral side portions 154 or with the lower flange 160, and extend outwardly and are of a size such that they completely prevent any movement of the lowermost edge of rhe casing 110 of housing 108 below the horizontal plane of the ledges 182. That is, as the carriage 150 is moved upwardly, the ledges 182 will abut the underside of the casing 110.

The operation of the power center 100 will now be described with respect to FIGS. 1-5. With the power center in a closed and retracted position as shown in FIG. 1, the upper cover plate 162 of the power carriage 150 is essentially flush with the housing collar 116. The power carriage 150 is maintained in the closed position by means of gravity, i.e. merely the weight of the power carriage 150.

When the user desires to extend the power center 100 upwardly by extending the power carriage 150 out of the rectangularly-shaped slot 102 in tne work surface 104 into an open position, the user can remove the second cover plate 164 or otherwise position his or her fingers below the portion of the upper cover plate 162 which extends to the right side of FIG. 1 away from the top of the receptacle box 152. The user can then exert upwardly-directed forces against the lower portion of the cover plate 162. These forces will cause the power carriage 150 to move upwardly relative to the housing 108. This upward movement will continue until the bosses 180 formed on the lateral side portions 154 of box 152 are actually sliding upwardly within the grooves 148 formed in the inner surfaces or casing 110. As the bosses 180 move further upwardly, they will contact the upper portion of each of the grooves 148.

The bosses 180 are of an appropriate size and of a sufficient flexibility or resiliency so that the bosses 180 can be essentially "squeezed" upwardly above the grooves 148 against the upper inner surfaces Of the casing 110. To achieve this movement, the user must exert a somewhat greater upwardly-directed force on the power carriage 150. As the power carriage 150 is moved upwardly a sufficient distance, the bosses 180 will be extended above the horizontally-disposed collar 116 of the housing 108. When the bosses 180 extend above the collar 116, the power carriage 150 will again move upwardly relatively freely, i.e. without any substantial forces exerted by the user other than those forces necessary to overcome the weight of the power carriage 150.

However, as the power carriage 150 is moved upwardly a sufficient distance, the lowermost edge of the casing 110 will abut the ledges 182 formed at the lowermost edges of the lateral side portions 154 of receptacle box 152. As earlier stated, the ledges 182 are of sufficient size so as to completely prevent any further upward movement of the receptacle box 152. If the user then releases the forces exerted on the power carriage 150, the receptacle box 152 can extend downwardly a relatively small distance to the extent that the bosses 180 support the receptacle box 152, with the bosses 180 abutting the upper edge of the casing 110. The actual distance between the bosses 180 and the ledges 182 can be of any desired length, so long as the distance between the bosses 180 and 182 is at least as great as the vertical "height" of the housing 108. Also, the positioning of the bosses 180 and ledges 182 should be such that with the bosses 180 resting on the upper edge of the casing 110, the power carriage 150 is extended upwardly a sufficient distance so that the electrical receptacles 170 are readily accessible to the user.

With the bosses 180 supported on the upper edge of the casing 110, the power carriage 150 is in the opened position as shown in FIG. 4. In this position, the electrical receptacles 170 will be located above the upper surface of the work surface 104 and the horizontal plane of the veneer 106. It is apparent that the actual position of the receptacles 170 relative to the planar upper surface of the work surface 104 will be dependen upon the initial positioning of the receptacles 170 on the receptacle box 154, and the positioning of the bosses 180.

With the receptacles 170 positioned above the work surface 104 and external to the slot 102, the user can then readily access the receptacles 170 to plug in desired electrical device power cords 176 and connected plugs 178. When the electrical devices have been energized, the user can then press downwardly on the upper cover plate 162 with a force sufficient so as to "squeeze" the bosses 180 into the opening formed by the inner surfaces of the casing 110. Accordingly, the power carriage 150 will then move downwardly. When the receptacle box 152 moves downwardly a sufficient distance so that the bosses 180 are again within the grooves 148, the weight of the receptacle box 152 will essentially cause the power carriage 150 to move relatively freely in a downward direction. As the power carriage 150 is moved downwardly, the electrical device power cords 176 will tend to position themselves in a manner so as to extend through the flexible brushes 168 and the opening formed at the opposing end of the second cover plate 164 when the second cover plate 164 is positioned in the opening formed by the horizontal collar 116. In accordance with the foregoing, the electrical device connected to the device power cord 176 is thus energized, with the power source connections substantially hidden from view. In this manner, the power center 100 advantageously provides an aesthetically-desirable power source outlet, with the further advantage that the power center 100 includes electrical receptacles 170 which can be extended upwardly from the work surface 104 so as to be made readily accessible to the user. Still further, the power center 100 is advantageous in that it does not incorporate any elements such as spring assemblies or similar mechanisms for purposes of power carriage movement. In addition, the user can readily move the power carriage 150 upwardly or downwardly relative to the housing 108 without the necessity of using special tools, rotating screws, or undertaking any other similar actions. The user must only exert forces upwardly or downwardly to move the power carriage 150 in the desired direction.

It should also be mentioned that the inwardlydirected flanges 118 located on the inner surfaces of the lateral side portions 112 of casing 110 also serve to provide in part a guide for the receptacle box 152. That is, the flanges 118 in combination with the inner casing surfaces on either side of the flanges 118 provide channels in which the receptacle box 152 can move in an upward or downward direction. The flanges 118 thus provide a means to maintain the vertical alignment of the receptacle box 152 relative to the housing 108. Furthermore, the casing 110 essentially comprises a symmetrical structure whereby two mirror-image half portions can be formed by taking a vertical section through the middle of casing 110. Accordingly, a receptacle box 152 can be located on either side of the flanges 118.

It will be apparent to those skilled in the pertinent art that other embodiments of power centers in accordance with the invention can be designed. That is, the principles of a manually-operable and retractable power center are not limited to the specific embodiments described herein. For example, mechanisms other than that described herein can be employed to rigidly secure the housing 108 to the work surface 104. Accordingly, it will be apparent to those skilled in the art that modifications and other variations of the abovedescribed illustrative embodiments of the invention may be effected without departing from the spirit and scope of the novel concepts of the invention.

The embodiments of the invention in which an exclusive property or privilege is claimed ar defined as follows:

1. A manually-operable power center adapted to be mounted in a desk or other furniture item having a work surface, and comprising a slot formed in the work surface, the power center comprising:

stationary housing means mounted within said slot;

electrical receptacle means for supplying electrical power from an interconnected common power source to selectively interconnected electrical devices;

carriage means received within said housing means for mounting said electrical receptacle means so as to be vertically moveable with respect to said housing means between a closed, retracted position and an extended, open position, said carriage means comprising opposing lateral sides;

first support means extending outwardly from said opposing lateral sides of said carriage means for supporting said carriage means in said extended, open position, said first support means abutting a top portion of the said housing means when said carriage means is in said extended, open position;

clamping means coupled to said housing means and rigidly securing said housing means to said work surface, wherein said clamping means comprises:

a pair of inwardly-directed flanges mounted to inner surfaces of said housing means, and comprising a central flange portion extending from a top portion of said housing means to a positon below a vertical midpoint of said housing means, side flange portions integral with said central flange portion and extending downwardly to a bottom portion of said housing means, and opposing guide slots formed in said side flange portions and extending in a vertical direction;

L-shaped locking members associated with each of said inwardly-directed flanges, and each comprising a vertical upright extending upwardly in a manner so as to be adjacent outer vertical surfaces of said housing means, a horizontally-disposed base portion integral with an associated vertical upright, and vertically-disposed tabs integral with said horizontally-disposed base portion and sized so as to be slidable within said guide slots;

clearance holes extending in a vertical direction in each of said central portion and in each of said horizontally-disposed base portions; and threaded means rotatably secured within said clearance holes, whereby rotation of said threaded means causes upward or downward movement of said L-shaped locking members relative to said housing means as a result of said vertical tabs being maintained within said guide slots, and wherein said housing means is rigidly secured to said work surface by the vertical uprights being abutted against a lower portion of said work surface.

2. A manually-operable power center in accordance with claim 1 and further comprising a pair of grooves integrally formed on inner vertical surfaces of said housing means and extending from a lowermost position of said housing means upwardly to a position near a top portion of said housing means.

3. A manually-operable power center in accordance with claim 2, wherein said first support means comprises a pair of bosses extending outwardly from said opposing lateral sides of said carriage means, and said bosses are aligned with said grooves so as to be receivable within said grooves when said carriage means is moved upwardly toward an extended, open position.

* * * * *